United States Patent [19]

Siech et al.

[11] Patent Number: 4,777,864

[45] Date of Patent: Oct. 18, 1988

[54] ELECTRONICALLY CONTROLLED, EXTERNALLY POWERED, AUTOMATIC GUN

[75] Inventors: Joseph L. Siech, Oregon; Steven R. Underwood, Port Clinton, both of Ohio

[73] Assignee: ARES, Inc., Port Clinton, Ohio

[21] Appl. No.: 608,768

[22] Filed: May 10, 1984

[51] Int. Cl.[4] ..... F41F 9/10

[52] U.S. Cl. ..... 89/45; 89/47; 89/33.03; 89/135; 364/144; 364/554; 364/569

[58] Field of Search ..... 89/45, 46, 47, 33.03, 89/135, 198, 43.01; 102/444; 364/142, 143, 144, 184, 554, 569; 901/46, 49; 73/167

[56] References Cited

U.S. PATENT DOCUMENTS

| | | | |
|---|---|---|---|
| 2,785,606 | 3/1957 | Bock et al. | 89/43.01 |
| 3,263,565 | 8/1966 | Dragonetti et al. | 89/1.804 |
| 3,331,284 | 7/1967 | Case, Jr. et al. | 89/126 |

*Primary Examiner*—Stephen C. Bentley
*Assistant Examiner*—Stephen M. Johnson
*Attorney, Agent, or Firm*—Allan R. Fowler

[57] ABSTRACT

An externally powered automatic gun or cannon system includes a gun with a pivoting chamber, a shell supply and a shell indexer and a shell rammer for feeding shells from the supply into the gun chamber for firing. Fluid pressure actuators are connected for operating the gun chamber, shell indexer and shell rammer and sensors are provided for sensing extreme operating positions thereof. Timing means are responsive to the sensors for determining lengths of operating times. Electronic control means, responsive to the sensors and timing means, control, on a step-by-step basis, operation of the actuators and firing apparatus according to a pre-established sequence of operational steps causing the automatic loading and firing of the automatic gun. Proceeding from one step of the sequence to the next step is conditioned on preselected ones of the gun working parts monitored by the sensors being in positions required by a pre-established position schedule and their operating times being within limits allowed by a pre-established timing schedule. Also included are automatic manfunction indicating means and failure prediction means, the latter predicting the number of shells yet to be fired before an out-of-limit condition occurs.

25 Claims, 7 Drawing Sheets

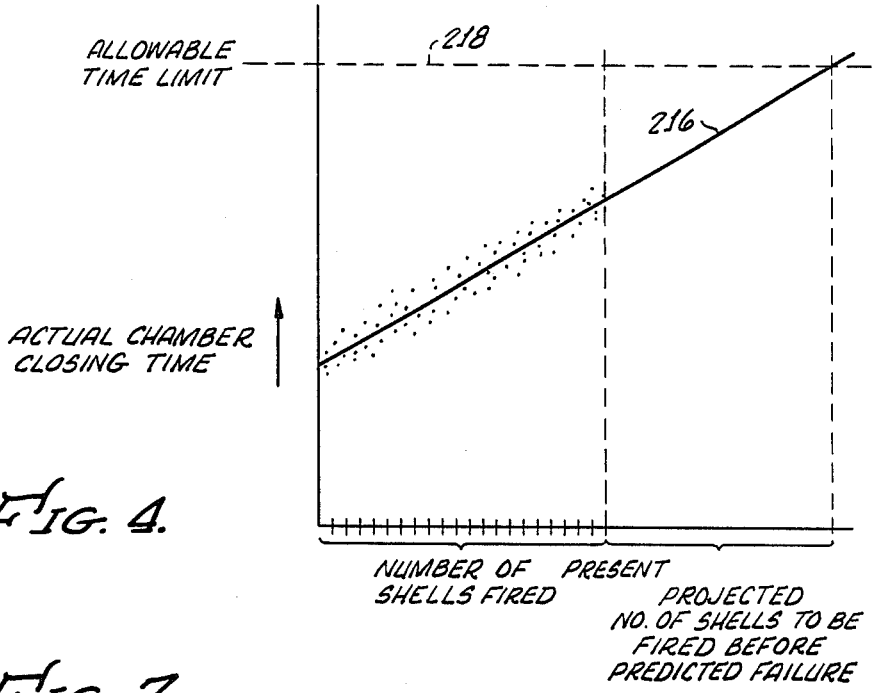
FIG. 4.
FIG. 7.
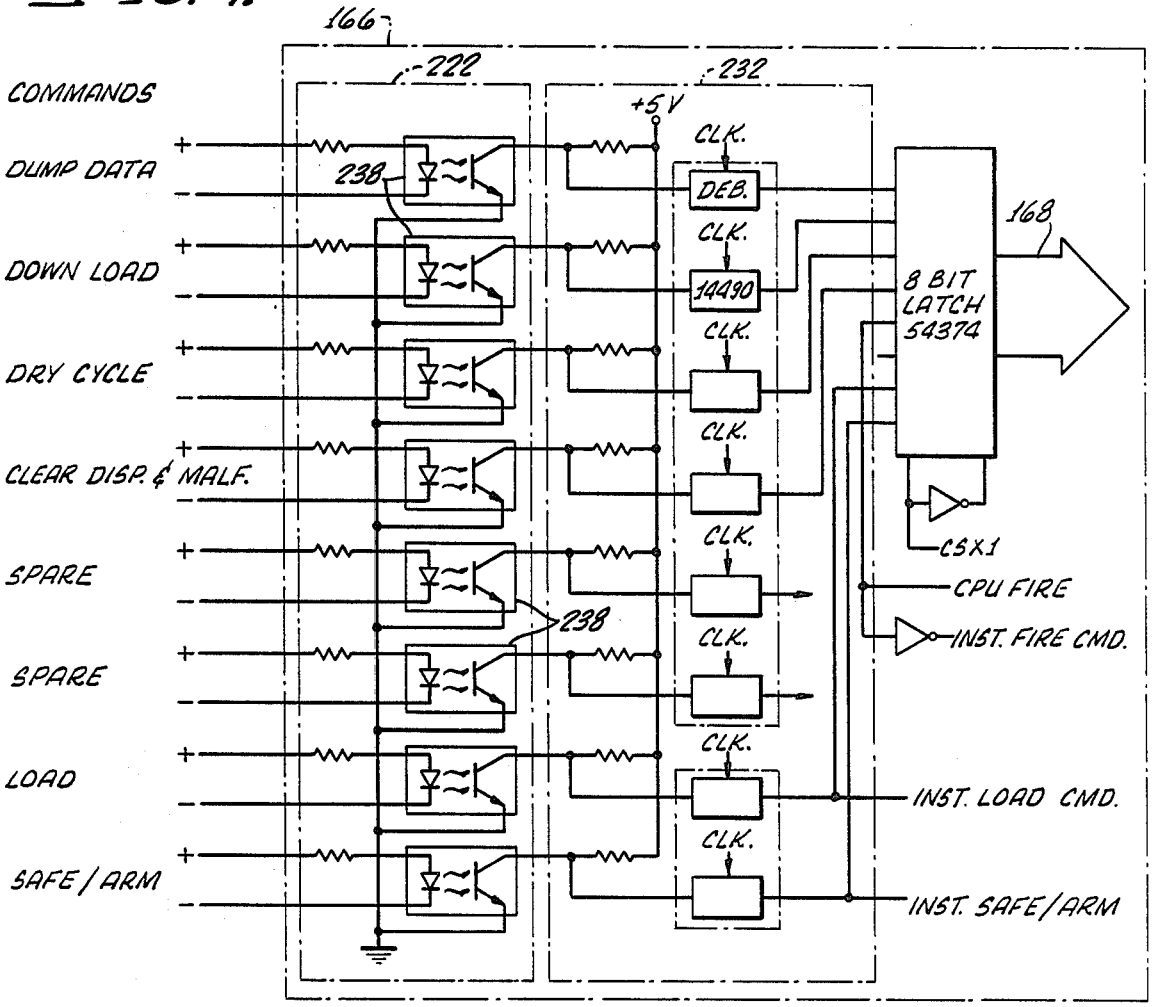

ELECTRONICALLY CONTROLLED, EXTERNALLY POWERED, AUTOMATIC GUN

This invention was made with Government support under Contract No. DAAK10-78-C-0026 awarded by the Department of Defense. The Government has certain rights in this invention.

BACKGROUND OF THE INVENTION

1. Field of the Invention

The present invention relates generally to the field of automatic guns and more particularly to the field of large calibre, externally-powered guns or cannon.

2. Discusson of the Prior Art

Many types of automatic guns, ranging in size from small calibre submachine guns to large calibre anti-aircraft and anti-tank guns, are used by the military. These automatic guns can be generally classified, according to their mode of operation, as either self-powered or externally powered. As implied, self-powered automatic guns utilize recoil or high pressure barrel gasses caused by firing to cycle operating mechanisms which load and fire the gun. In contrast, operating mechanisms of externally-powered guns are driven by actuators or motors independently of firing forces.

Self-powered automatic guns are inherently more portable or mobile than externally-powered guns and are, therefore, usually preferred for small arms, machine guns and light cannons, such as typically also being comparatively easy to implement as self-powered guns. For larger cannons, the associated weapons systems typically must provide auxiliary power for gun aiming movement. As a result, the providing of external power also to operate the gun itself is usually not a great disadvantage. Since such larger guns are difficult to implement as self-powered guns, because of shell size and weight and massiveness of moving operational parts, larger guns have typically been constructed to be external powered.

In the intermediate, approximate 20 through 40 mm cannon size range, some automatic guns are constructed as self-powered and others as externally powered, depending on specific system and performance criteria. For example, if auxiliary gun-operating power can be provided at no great sacrifice of gun size or weight, externally-powered guns may be preferred because of their potentially greater firing rates. On the other hand, if size constraints and weapons system mobility are important, self-powered guns are usually preferred.

Large guns, that is, those of about 75 mm calibre and larger, have typically been found very difficult to fully automate, even by use of external power. This is because the shells are large and cumbersome and the guns themselves are massive. In particular, automation of such large guns for operational use in the tight confines of armored vehicles has been especially difficult because of space limitations.

As a result, automation of all large guns in general, and of those used in tanks and armored vehicles in particular, has heretofore usually been limited to the automation of single operational functions, for example, opening and closing the breech or loading shells into an open breech. A human operator has ordinarily functioned to operationally bridge the separately automated functions. Firing rates of such guns, in which an operator performs the key role as system integrator, have thus been limited by the operator's skill and ability in perceiving the operational status of the automated gun hardware and in deciding when the operating commands should be given to initiate each successive automated operation.

Many problems encountered in mechanizing large guns are believed attributable to the fact that the guns were not originally designed for automatic operation. Thus, design of such guns has principally involved adaptations of pre-existing, manually operated guns. As a consequence, their automation has usually consisted of little more than the retrofitting of existing gun hardware. Although some limited success has been achieved through such retrofitting, the resulting gun systems have, at best, been awkward and non-optimal in terms of gun operating speeds and firing rates, and also in terms of system cost and reliability. These retrofit-type gun systems have, therefore, usually had little appeal to intended military customer and so far as is known to the applicants, none has ever been put into production.

Moreover, control systems for such previously automated large calibre guns have to applicants' knowledge, heretofore controlled only a few sequential steps and have been implemented by simple AND or OR logic elements, flip-flop circuits typically being used to control actuating motors or solenoids. Also, the progression from one separately automated step to another has heretofore been sequenced by pre-set timers, so that gun operation proceeds in accordance with a fixed time schedule. Reliance upon such timing schedules, however, can cause serious problems because operating times may, in fact, vary widely in the same gun according to conditions. For example, the time required to advance shells to the gun typically varies according to the number, and hence the mass, of shells which must be advanced. Operating times also depend upon such factors as how clean or how well lubricated the gun is, the extent of gun wear and the operating temperatures. If the gun design does not take such time-affecting variables into consideration, one operating step may be initiated before a preceding step is completed, with potentially disastrous consequences.

A particular event which is difficult to provide for in a fixed timing schedule is shell firing time. Typically shells fire within a few milliseconds after firing impact or, as the case may be, electrical contacting. Propellant combustion ordinarily occurs within the next few milliseconds and casing pressure is typically reduced to a safe casing extraction level in several more milliseconds. Thus, only about 10 to 20 milliseconds of firing "dwell time" is ordinarily required.

However, in system use, some few shells, presumably due to manufacturing defects, do not fire as expected. Instead, there is a brief delay after impact or electrical contact before ignition occurs. This phenomenon is commonly referred to as a "hang fire" condition. If a hang fire causes a shell to fire after a timed casing extraction has begun, the gun may be destroyed and operating personnel may be injured. On the other hand, if worst case hang fires are considered in establishing the gun operating time schedule, gun performance will be compromised. If the timing schedule also takes into account all other possible worst case conditions affecting gun operating times, the firing rate will be drastically reduced over that possible under most operating conditions. As a result, the automatic operation of a gun on a fixed timing schedule is generally unsatisfactory.

It is, therefore, an object of the present invention to provide an externally-powered, automatic gun system in which operation of the gun does not proceed on a fixed time schedule.

Another object of the present invention is to provide an externally-powered, automatic gun system in which the initiation of any operational step in a sequence of operating steps is conditioned upon the proper completion of the preceding operational steps.

Still another object of the present invention is to provide an externally-powered automatic gun system in which the operating times of at least some of the operational steps are measured and are compared with pre-established operating times, and in which operation of the gun is stopped if any of the pre-established operating times are exceeded.

A further object of the present invention is to provide an externally-powered automatic gun system which operates on a strict logic basis, rather than on a fixed timing schedule and which stops operating if pre-established logic conditions are not met and which, moreover, provides status and malfunction information to the gun operator.

Another object of the present invention is to provide an externally-powered, automatic gun system in which initiation of each operational step is conditioned on specific moving parts of the gun being in specific positions.

Yet another object of the present invention is to provide an externally-powered automatic gun system whose operating system provides failure predictions based, at least in part, upon operating times of moving parts of gun system.

Other objects, features and advantages of the present invention will be readily apparent from the following detailed description when taken in conjunction with the accompanying drawings.

SUMMARY OF THE INVENTION

An externally powered, automatic gun system, according to the present invention, comprises a gun having a shell chamber and a gun barrel, shell supply means for holding shells to be fired by the gun, and a plurality of operating means enabling the opening and closing of the shell chamber and the transferring of shells from the shell supply means into the chamber for firing. Actuating means are connected to the plurality of operating means for causing the operation thereof so as to enable loading of the gun and firing means are provided for causing firing of shells in the shell chamber. Sensing means are included for automatically sensing preselected operating positions of the plurality of operating means. Timing means, responsive to the sensing means, are provided for determining the operating lengths of the plurality of the operating means by the actuating means. Included are electronic control means connected to the actuating means and firing means for the controlling thereof in accordance with a pre-established sequence of operating steps causing the automatic loading and firing of the gun. The control means are responsive to the sensing means and timing means in a manner causing the advancing from one operational step to the next-in-sequence operational step only when preselected ones of the plurality of operating means are positioned, as required for the operational step involved, by a pre-established positional schedule and pre-selected ones of the operating time lengths are, for the operational step involved, within operating limits allowed by a pre-established timing schedule.

Preferably the plurality of operating means include means for pivotally mounting the gun breech for rotational movement between a closed position, in which a shell in the chamber is aligned with the gun barrel for firing, and an open, shell loading/ejection position, in which the chamber is out of alignment with the gun barrel. The operating means further include shell advancing means enabling the advancing of shells from the shell supply means to a shell ram position and shell ramming means enabling the advancing of shells from the ram position into the open chamber.

The sensing means are configured for sensing whether the chamber is open or closed and for sensing the extreme positions of movement of selected parts of the shell advancing means and the shell ramming means. Accordingly, the control means are operative for progressing from one operating step to the next-in-sequence operating step only if the chamber is, for the involved operational step, opened or closed as required by the pre-established chamber position schedule and preselected ones of the operating parts of the shell advancing means and the shell ramming means are, for the operational step involved, positioned as required by the pre-established operational parts position schedule.

The gun is mounted for recoiling, after firing, out of an at-rest, battery position, the sensing means being also operative for sensing whether or not the gun is in the battery position, and the timing means being also operative for determining, after a firing, the length of time required for the gun to return to the battery position.

Correspondingly, the electronic control means are further operative for causing the automatic proceeding from one step of the sequence of operational steps to the next-in-sequence step only if the gun is in battery as required by the positional schedule for the operating step involved.

Further, according to the present invention, the control means include means enabling the automatic firing of a preselected number of shells, the loading and firing of each shell of the selected number being accomplished in accordance with the pre-established sequence of operational steps and being conditioned on the criteria for proceeding from one step of the sequence to the next step of the sequence, the automatic proceeding from one sequence of operational steps to the next sequence of operational steps being conditioned on such criteria and also on the length of the out-of-battery time caused by the firing of a just-fired shell being within the out-of-battery time range allowed by the timing schedule.

Preferably, the gun includes a pressurized fluid recoil buffer, the sensing means being operative for sensing fluid pressure in the buffer and the electronic control means being operative for causing the firing means to fire a shell in the chamber only if the sensed fluid pressure in the buffer is greater than a preestablished buffer pressure level.

Malfunction indicating means are included for providing malfunction information as to the reason for any failure of the control means to cause the proceeding from one step of the sequence of operating steps to the next-in-sequence step. Moreover, in the repetitive firing mode of operation, the malfunction indicating means indicate the reason for any failure of the control means to cause the proceeding from one sequence of operational steps to the next sequence of operational steps. In order to inform gun operators as to the nature of such failures the malfunction indicating means provide the malfunction information to a visual display.

For purposes of testing, the electronic control means are operative for selectively causing the actuating means to operate in accordance with a pre-established sequence of test steps by which test (inert) rounds are loaded and "fired". Data recording means are connected to the sensing means and the timing means for recording operational position and operation length of time data for each step in the sequence of test steps.

The automatic gun system may further include failure predicting means for predicting when the actual lengths of any operating time, as determined by the timing means, may, for any step in the sequence of operating steps, be expected to be outside the corresponding, pre-established operating time allowed by the timing schedule. In this manner, a gun malfunction caused by failure of the control means to cause the proceeding from one operational step in the sequence of operational steps to the next-in-sequence operational step can be predicted. The predicting means are operational for determining, for selected ones of the lengths of operating time, provided by the timing means, the rate of change of the length of operating time per a selected number of shells fired and for next projecting the lengths of operating times forwardly at the determined rates of change until the projected lengths of operating times are outside of the pre-established lengths of operating times allowed by the timing schedule. The predicting means then determine the projected number of shells to be fired before the projected lengths of operating times exceed the preselected limits so as to enable the forming of a future gun maintenance schedule which will substantially reduce gun failures. Preferably the failure predicting means are operational for updating, in accordance with a pre-established updating schedule, the determination of the projected number of shells to be fired before an out-of-limit length of operating time is expected to occur.

For optimum operation, the gun chamber and shell supply means are configured for holding cylindrically shaped, telescoped shells. The gun chamber is pivotally mounted relative to the gun for rotational movement between a closed, shell firing position and an open shell loading position, a fired shell casing being caused to be ejected from the chamber by the loading of an unfired shell into the chamber.

BRIEF DESCRIPTION OF THE DRAWINGS

A better understanding of the present invention may be had from a consideration of the following detailed description, taken in conjunction with the accompanying drawings in which:

FIG. 4 is graph plotting an exemplary length of operating time of an exemplary one of the actuators vs number of shells fired to illustrate a manner in which a failure of the gun system is predicted;

DESCRIPTION OF THE PREFERRED EMBODIMENT

Figure 1:
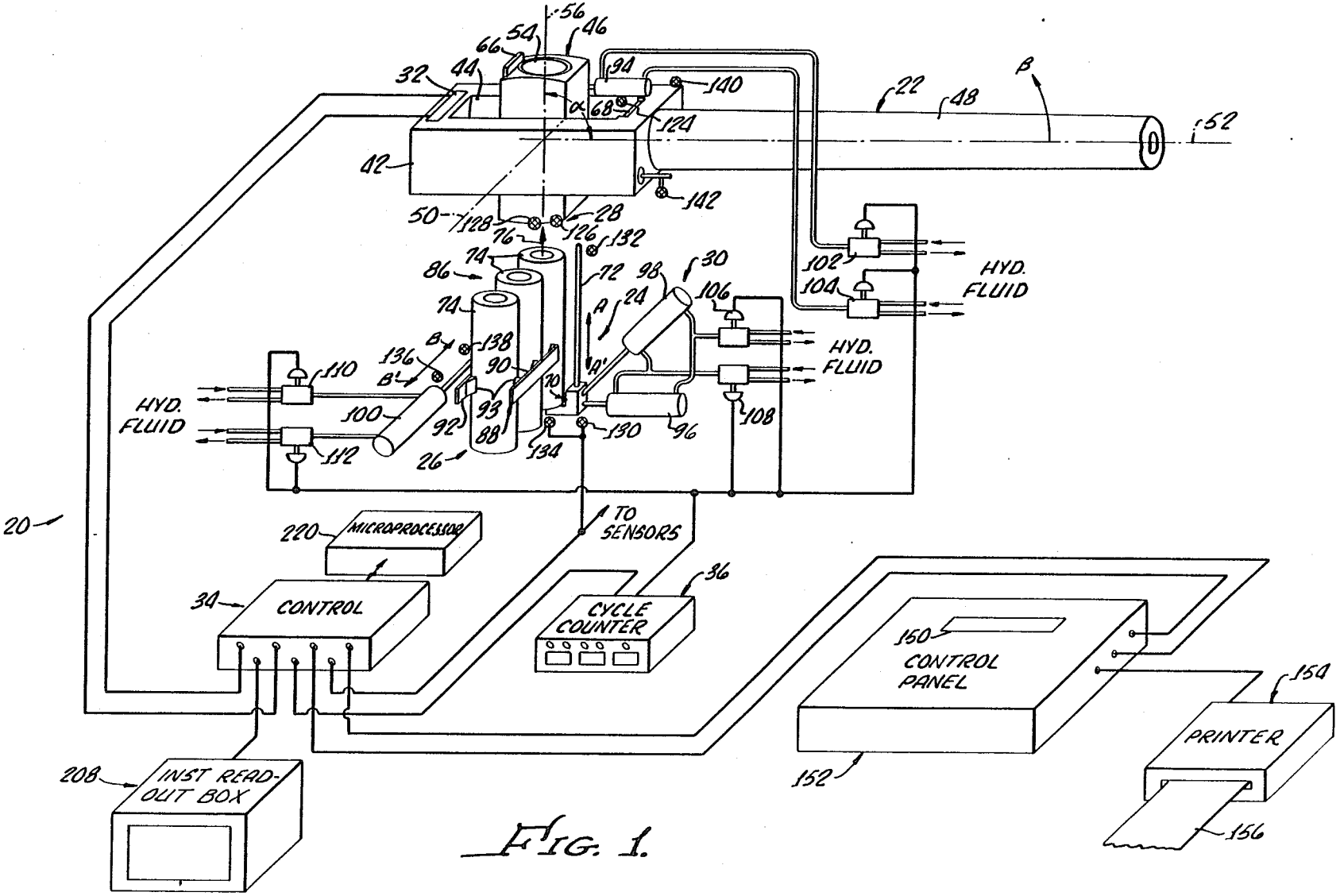
FIG. 1 is a pictorial drawing showing an externally powered, automatic gun system having a plurality of actuators for causing operation of the gun and a plurality of sensors for sensing positions of working parts of the gun; and showing an electronic control means, which is responsive to the sensors for controlling the actuators.

An externally powered, automatic gun system 20 is depicted in FIG. 1. As shown, gun system 20 comprises generally a gun or cannon 22, shell feeding or ramming means 24 and shell supply means 26. Included in gun system 20 are sensing means 28, actuating means 30, firing means 32, electronic control means 34 and cycle counting means 36.

Gun 22 may, for example, be of the type disclosed in copending U.S. patent application, Ser. No. 559,304 filed Dec. 8, 1983, and includes a rectangular breech 42 having an aperture 44 in which is pivotally mounted a chamber 46. A gun barrel 48 is fixed to a forward end of breech 42. Chamber 46 is pivotally mounted on a transverse axis 50 which intersects a barrel bore axis 52. A shell holding aperture 54 is formed lengthwise through chamber 46 along a chamber longitudinal axis 56. When chamber 46 is pivoted by portions of actuating means 30, in a manner described below, to a closed, shell firing position, chamber axis 56 is aligned with barrel bore axis 52. As shown in FIG. 1, chamber 46 can be rotated to a fully open position in which, when barrel 48 is horizontal, chamber axis 56 is at 90° to barrel bore axis 52.

In operation, chamber 46 is pivoted open (as described below) until the chamber hits an associated fixed stop (not shown), at which chamber axis 56 is vertically oriented. As gun 22 is elevated about an elevational axis coincident with chamber pivotal axis 50, the angle, $\alpha$, between barrel bore axis 52 and chamber axis 56 of the open chamber varies according to the barrel elevational angle, $\beta$. Chamber 46 is always, however, opened to the same vertical orientation regardless of barrel elevational angle, $\beta$, as is important for shell loading. Conversely, when chamber 46 is pivoted closed, the chamber is rotated until a projecting lip 66 thereof engages a recessed breech surface 68 which serves as a chamber stop. As is, therefore, apparent, as chamber 46 is pivoted to its open stop, the chamber pivoting angle, $\alpha$, depends upon the barrel elevational angle, $\beta$, which for the type of gun shown is a maximum of about 45°. The chamber closing angle is also obviously dependent upon barrel elevation angle. In any event, chamber 46 is always operated between the open stop and closed stop positions.

Shell ramming means 24 comprise a shell-engaging shell ram 70 which is vertically movable, along a vertically oriented track 72. As more particularly described below, ram 70 is actuated by portions of actuating means 30, between a pre-established ram-down position (shown in FIG. 1) and a pre-established ram-up position in which a shell 74 (preferably of the telescoped type) engaged by the ram is loaded into chamber aperture 54. Ram 70 is, therefore, operated between ram-down and ram-up stops, not shown. It will be appreciated that because gun 22 is elevated about axis 50, about which chamber 46 also pivots, chamber axis 56 is always aligned with a shell ram axis 76 when the chamber is pivoted to its full open position.

Also as shown in FIG. 1, shell supply means 26 comprise a magazine portion 86, in which a number of shells 74 are stored, and shell indexing or advancing means 88. Shell indexing means 88 comprise a fixed horizontal plate 90 and a movable horizontal plate 92, the movable plate being connected to portions of actuating means 30. Spring loaded pawls 93 on plates 90 and 92 are mounted and configured so that when plate 92 is moved toward ramming means 24, several shells 74 held by shell advancing means 88 are advanced one shell position, the endmost shell being thereby advanced to a shell ramming position in which shell ram 70 engages a shell for loading upwardly into gun chamber 46. The pawls 93 on fixed plate 90 permit movable plate 92 to be retracted (by actuating means 30) in readiness for a next shell advancing without moving the shells back away from ramming means 24. Shell advancing means 88 are configured so that movable plate 92 is moved between a fully retracted stop (not shown) and a fully extended stop (also not shown) during operation by actuating means 30. Construction of shell advancing means 88 may, for example, be similar in construction and operation to corresponding shell feeding apparatus disclosed in U.S. Pat. No. 4,348,938 to Gillum, and such patent is incorporated by reference hereinto to the extent applicable for disclosure purposes.

For the exemplary configuration of gun system 20, actuating means 30 comprises four double acting hydraulic cylinders or actuators 94, 96, 98 and 100. Actuator 94 is connected for opening and closing chamber 46, being thereby connected between the chamber and breech 42. Actuators 96 and 98 are both connected to ram 70, actuator 96 being mounted about horizontally and actuator 98 being mounted at a vertical angle of about 45° to actuator 96.

The two actuators 96 and 98 are connected and operated in a push-pull relationship, actuator 96 being extended while actuator 98 is being retracted to move ram 70 from the ram-down to the ram-up position (direction of Arrow A). Ram 70 is moved downwardly (direction of Arrow A') by retraction of actuator 96 and extension of actuator 98. Actuators 96 and 98 are mounted relative to ram 70 so as to provide rapid acceleration and rapid deceleration of ram 70 at the respective beginning and end of its operational stroke in either direction, to thereby reduce impact stresses at the ram-up and ram-down stops. Actuator 100, in turn, is connected to movable plate 92 of shell advancing means 88 to cause its shell advancing extension and its subsequent retraction in the respective direction of Arrows B and B'.

Actuating cylinders 94, 96, 98 and 100 are operated by six electric solenoid valves 102, 104, 106, 108, 110 and 112, which control the flow of pressurized fluid, preferably hydraulic fluid from a source (not shown) to the cylinders. As such, valve 102 is connected to actuator 94 to provide pressure to cause pivotal opening of chamber 46, whereas, valve 104 supplies pressure to such actuator to cause chamber closing. In a similar manner, valve 106 is connected to actuators 96 and 98 so as to cause upward, shell feeding movement of ram 70 and valve 108 is connected to the same actuators in a manner that the energizing thereof causes the ram to move from the ram-up to the ram-down position. Also, in a similar manner, valve 110 is connected to actuator 100 to cause shell advancing movement of the movable plate 92; whereas, valve 112 is connected to actuator 100 to cause retraction of movable plate 92.

Therefore, energyzing of solenoid valves 102, 104, 106, 108, 110 and 112 in a pre-established sequence causes associated actuators 94, 96, 98 and 100 to move gun chamber 46, shell rammer means 24 and shell advancing means 88 in a manner causing the automatic loading of gun 22 with shells 74 from supply means 26. As more particularly described below, function of electronic control means 34 is to energize such solenoid valves 102–112 in the pre-established operating sequence causing gun operation.

In order to determine the positional status of gun chamber 46, ram 70 and movable, shell-advancing plate 92, sensing means 28 provide a number of electric or electronic position sensors, preferably of the non-contact, magnetic or Hall-Effect type. Accordingly, a sensor 124 is provided for sensing when chamber 46 is fully closed and a sensor 126 is provided for sensing when the chamber is fully open. Preferably a third chamber sensor 128 is provided to detect when chamber 46 has just left the fully open position and has started to close. Sensors 130 and 132 are provided to detect or sense, respectively when ram 70 is in the ram-down and the ram-up positions.

Associated with ram position sensors 130 and 132 is a sensor 134 which senses when a shell 74 is in the ram position in readiness to be rammed, by ram 70, into chamber 46. Two additional sensors 136 and 138 are provided for detecting, respectively, when the shell advancing movable plate 92 is in the retracted or extended positions. Thus, sensors 124 and 126, sense extreme operational positions of chamber 46, sensors 130 and 132 sense extreme operational positions of ram 70 and sensors 136 and 138 sense extreme operational positions of movable plate 92.

Gun 22, including barrel 48, breech 42 and chamber 46, is resiliently mounted for recoiling after a shell firing, from the static, battery position depicted in FIG. 1. Sensing means 28, therefore, preferably include another position sensor 140 which senses when gun 22 (actually breech 42) is in the battery position. Also, the particular gun 22 depicted utilizes a pressurized fluid recoil buffer (not shown) which is installed in breech 42. To sense fluid pressure in the buffer, sensing means 28 further include a pressure sensor 142. According to the particular gun configuration involved in system 20, sensing means 28 may include other sensors as may be needed to completely monitor the position of key moving parts (or selected ones of such key moving parts) as well as to monitor other important system parameters.

Inasmuch as electronic control means 34 function to control the automatic operation of solenoid valves 102–112 which operate gun system 20 through actuating means 30, all the above-mentioned sensors 124–142 are electrically connected to the control means. Firing means 32 are also connected to electronic control means 34.

In general, and as more particularly described below, electronic control means 34 are configured and are operative for electrically operating solenoid valves 102–112 and firing means 32 in accordance with a preselected or preprogrammed sequence of operating steps which cause the automatic loading and firing of gun 22. Control means 34, are further configured for causing the progressing from any step of the pre-established sequence of operating steps to the next-in-sequence step or from the last step of one sequence of operating steps to the first step in the next sequence (in a burst firing operational mode) only if gun system 20 is in proper condition and configuration, as detected by sensing means 28. Also importantly, as described below, control means 34 include clock timing means response to output of sensing means 28 for determining the lengths of times required for actuating means 30 to move chamber 46 between open and closed and between closed and open positions; to move ram 70 between ram-down and ram-up positions and between ram-up and ram-down positions and to move plate 92 between retracted and extended positions and between extended and retracted positions. Such actual operating times are compared with pre-established (stored) allowable operating times and are used as additional criteria in the step-by-step, "go/no-go" control by control means 34.

Also included in control means 34, as described below, are intitializing means enabling the control means to operate actuating means 30 in a preselected manner causing the chamber 46, ram 70 and movable plate 92 to move to pre-established initial positions. Such initialization of operationally movable parts of gun system 20 is caused to occur by control means 34 when the control means is turned on and before the sequence of steps causing loading and firing of gun 22 is commenced. Only if the moving parts involved are properly initialized (that is, are moved to, or are in, proper initializing positions) within pre-established times, as determined by the timing means from output signals from sensing means 28, is commencement of the operational sequence causing loading and firing of gun 22 enabled and intitiated.

Since electronic control means 34 cause operation of gun system 20 to proceed on a step-by-step, go/no-go basis, dependent upon positions sensed by sensing means 28 and upon times determined by the timing means, operational stoppages or interruptions occur if out-of-tolerance conditions or times occur. Effectiveness of control means 34 is, therefore, enhanced by provision to display, for example, on a display 150 of a control panel 152, the nature of the malfunction for diagnostic or trouble-shooting purpose. For such purpose a pre-programmed library of malfunction messages may be electronically stored in ROM portions of control means 34. As shown in FIG. 1, a data output printer 154 may be electrically connected to control panel 152 so that a data tape 156, containing information as to operation of gun system 20, can be provided for historical, maintenance and/or trouble-shooting purposes.

Figure 2:
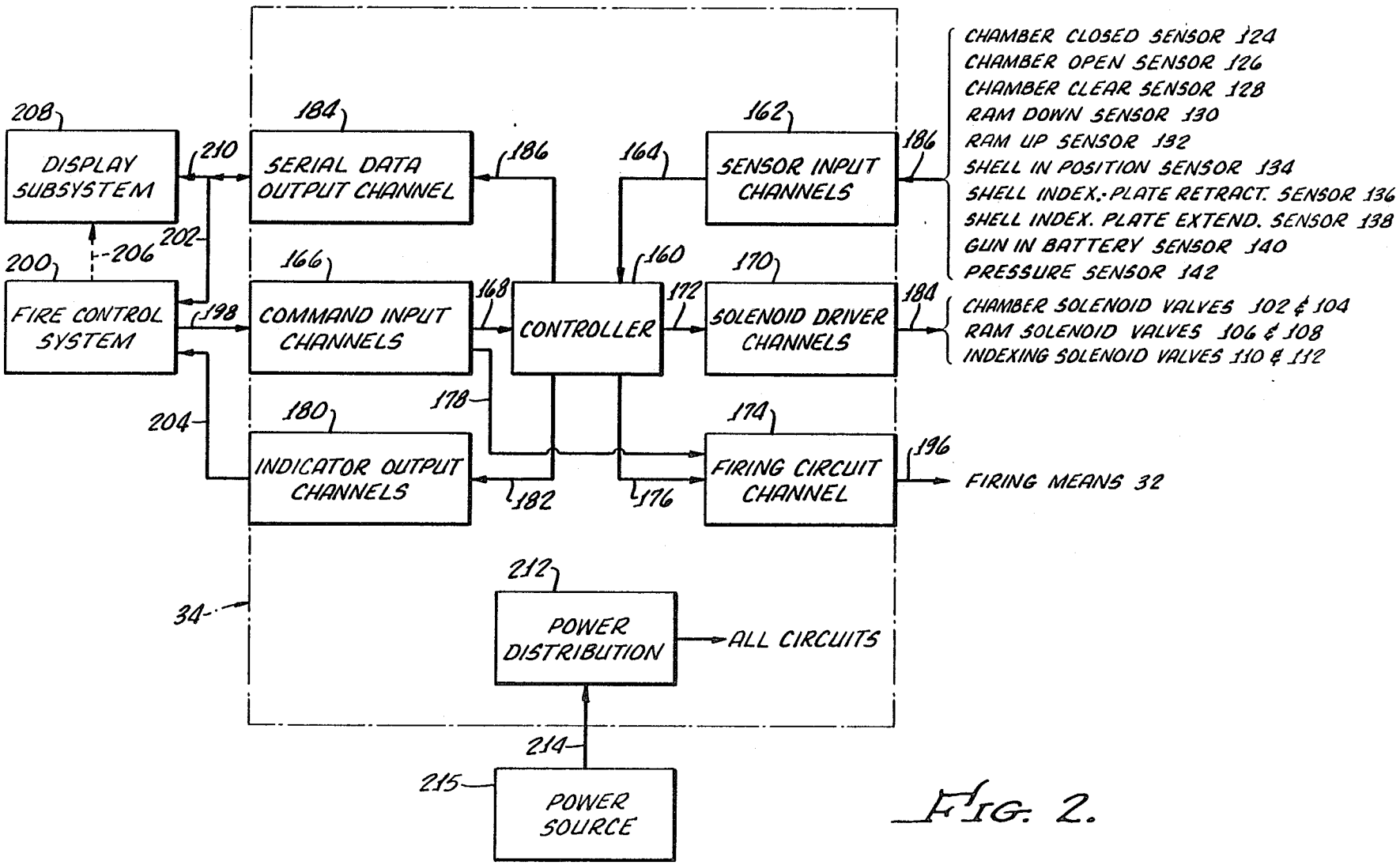
FIG. 2 is a functional block diagram showing the architecture of the electronic control means of FIG. 1.

FIG. 2 shows, in functional block diagram form, the general architecture of electronic control means 34. As indicated, the heart of electronic control means 34 is a microprocessor controller 160 to which positional information for the gun system operatiing parts is fed from sensor input channels 162 via a conduit 164, and command signals are fed from command input channels 166, via a conduit 168. Controller 160 feeds output signals to solenoid driver channels 170, via a conduit 172, and to firing circuit channel 174 via a conduit 176, the firing circuit channel also receiving control signals from command input channels 166 via a conduit 178. Controller 160 additionally outputs data to indicator output channels 180 via a conduit 182 and to serial data output channel 184 via a conduit 186.

Solenoid driver channels 170 provide actuating signals to chamber solenoid valves 102 and 104, to ram solenoid valves 106 and 108 and to indexing plate solenoid valves 110 and 112 via a conduit 184. Sensor input channels 162 receive, via a conduit 186, signals from the various positional sensor 124–140 and from pressure sensor 142. Firing circuit channel 174 provides firing control signals to firing means 32 via a conduit 196. Command input channels 166 receive commands, via a conduit 198, from a fire control system 200 which includes control panel 152 (FIG. 1), or some variation thereof, as well as other indicators and panels (not shown). Serial data output channel 184 and indicators output channels 180 provide data to fire control system 200 via respective conduits 202 and 204. Fire control system 200 also provides data, via a conduit 206, to a display subsystem 208. Serial data output channel 184 and display subsystem 208 communicates with each other via a conduit 210.

Electric power is provided to all electronics in electronic control means 34 by a power distribution system 212, which is, in turn, fed electric power, via a conduit 214 from an appropriate power source 215 Such power source may, for example, be a +28V vehicle/fire control voltage supply.

Figure 3:
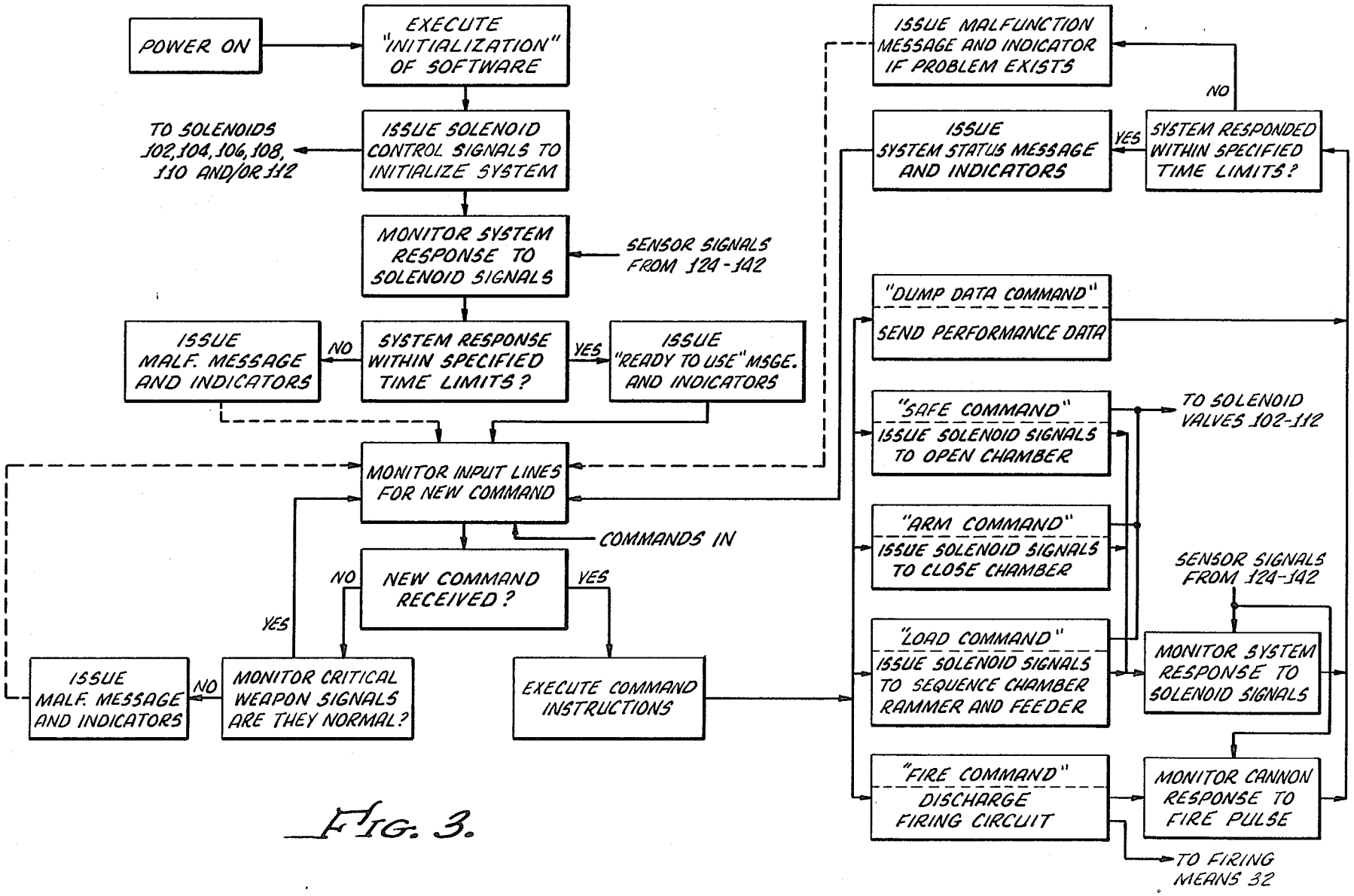
FIG. 3 is a functional flow diagram of the electronic control means of FIG. 1.

Operation of control means 34 is generally as depicted in flow diagram form in FIG. 3. When electronic control system 34 has been deenergized, moving parts of gun system 20 may not be in proper positions, due, for example, to servicing, to initiate operating of the system. Therefore, when control means 34 are energized, operating signals are outputted to preselected ones of solenoid valves 102–112 causing chamber 46, ram 70 and shell moving plate 92 to be moved to, or maintained in, pre-established (preprogrammed) initialization or start-up positions. Control means 34 then monitor the response to the initializing procedure as provided by sensors 124–142.

If the sensor output signals indicate that the initialization operation has been successfully completed within preestablished (preprogrammed) allowable time intervals, a "READY TO USE" message and/or other related indicators (as applicable) are outputted (for example, to display subsection or instrumentation readout box 208, FIGS. 1 and 2). Input lines, for example, conduit 198, are then monitored for follow-on commands such as "ARM", "SAFE", "LOAD", or "FIRE".

However, if the initialization operation was not completed as required, malfunction messages and indicators (as applicable) are provided. As indicated by a dashed line in FIG. 3, the command input lines are monitored for commands specifically allowed in such case. These allowable commands may include "DUMP DATA" and certain manual override commands which enable proceeding with the normal "ARM", "SAFE", "LOAD", and "FIRE" commands, according to an operator's assessment and/or correction of the malfunction situation.

If, after initialization, no new commands are received, preselected critical sensor signals are rechecked and if the signals show that the gun system is still in readiness, the input lines are rechecked for new commands. As long as no new commands are received, and the system is in proper condition, the signal monitoring and line rechecking continue until a new command is received. If any of the monitored critical sensor signals are, however, not as required, the cycling stops, malfunction messages and indicators are provided and the signals are monitored and the input lines are rechecked for allowed commands.

Assuming proper system intitialization with all critical weapon signals normal, when an additional command, such as "SAFE", "ARM", or "LOAD", is received over the monitored input lines, control means 34 execute pre-established command instructions to solenoid valves 102–112. By way of illustration, if the command "LOAD" is received, a preselected sequence of operating commands to solenoid valves 102–112 are generated and the response thereto is determined by monitoring the input signals from sensors 124–142. If the gun system responds properly and within allowed tme intervals, a status message such as "GUN LOADED" is provided and appropriate indicators are energized. The command input lines are then monitored for a next command, such as "FIRE" or "SAFE". If no additional commands are received, the system cycles as above-described. When a subsequent command is received, appropriate command instructions are executed and the system progresses through the command stops, checking of proper system response thereto and then monitors the input lines for new commands.

If, on the other hand, the system does not respond as required to the sequence of operating commands, a malfunction message is provided and indicators are energized and the input lines are monitored for such allowable commands as manual override. In this regard, it should be appreciated that when such malfunction criteria as specific lengths of time for operating parts to move through their operating cycles or strokes are exceeded, slightly greater lengths of operating times than those programmed into the system may not, in fact, represent a critical problem. Therefore, a gun operator may, in such circumstances have the option to manually override the "malfunction" and operate the gun, as may sometimes be necessary.

As is apparent from the above description relating particularly to FIG. 2 and even more particularly to FIG. 3, an important feature of control means 34 is the continual, automatic monitoring of gun system response, (by sensors 124–142), to pre-established control commands provided to solenoid valves 102–112. The sequencing of steps which load and fire gun 22, and which perform other operations, such as satisfying and arming the gun (that is, opening and closing chamber 46), automatically progresses in a preprogrammed manner only so long as the above-described working parts of gun system 20 are positioned as required by a preprogrammed parts position schedule and/or selected operating times are within limits allowed by a preprogrammed timing schedule. It will, of course, be understood that the positions and operating times of all working parts (chamber 46, ram 70 and indexing plate 92) are not necessarily monitored and used as a "go/no-go" criteria for each step of each operational sequence of steps, there being typically selected for each operational step those positional and timing criteria that are deemed critical for the step involved.

Another important feature of control means 34 is the self-diagnostic aspect whereby preprogrammed malfunction information is automatically outputted in an intelligible manner to gun operators, so as to thereby enable an operator to pinpoint the problem area for corrective action or to decide whether or not to initiate an override command.

Still another important aspect of electronic control means 34 is the capability for predicting failures based on operating time enabled by sensors 124–142. As an example, the programmed timing schedule may permit a chamber closing time, for full open to full closed, of no greater than about 350 ms. However, the actual chamber closing times can ordinarily be expected to increase with the number of shells fired. This is due to deterioration of lubrication, build up of propellant products, galling between sliding contact parts, and so forth. As shown in the graph of FIG. 4, the actual chamber closing times are plotted against number of shells fired and a line 216 is, by such known techniques as least squares or regression analysis, fit to the data and is extrapolated ahead in terms of number of shells until the allowable time limit line 218 is intercepted. Based on such extrapolation, which may be performed within microprocess portions of control means 34, a projected number of shells to be fired before the allowable time limit is exceeded is determined and can, for any or all desired parameters, be visually displayed or otherwise outputted. As a result, the gun operator can generally anticipate a gun malfunction before it actually occurs and can initiate preventive measures. Preferably, because of changing gun conditions, such failure predictions are periodically updated, for example, by basing the projections upon a predetermined number of most recent shell firings. These failure predictions may be made for any or all of the operating lengths of time and may be made for other monitored gun parameters such as buffer fluid pressure. The predictive function described may, for example, be performed by a microprocessor 220 (FIG. 1) which, while shown as a separate element may, in fact, be a main element in control means 34.

Electronic control means 34, as described above, can be implemented in a variety of ways, as can be appreciated by those skilled in the electronic circuit and system design arts. The logic functions of control means 34 are preferably performed by a suitably programmed, internal microprocessor but may alternatively be performed by an associated fire control computer, or general purpose computer (not shown).

Figure 5A:
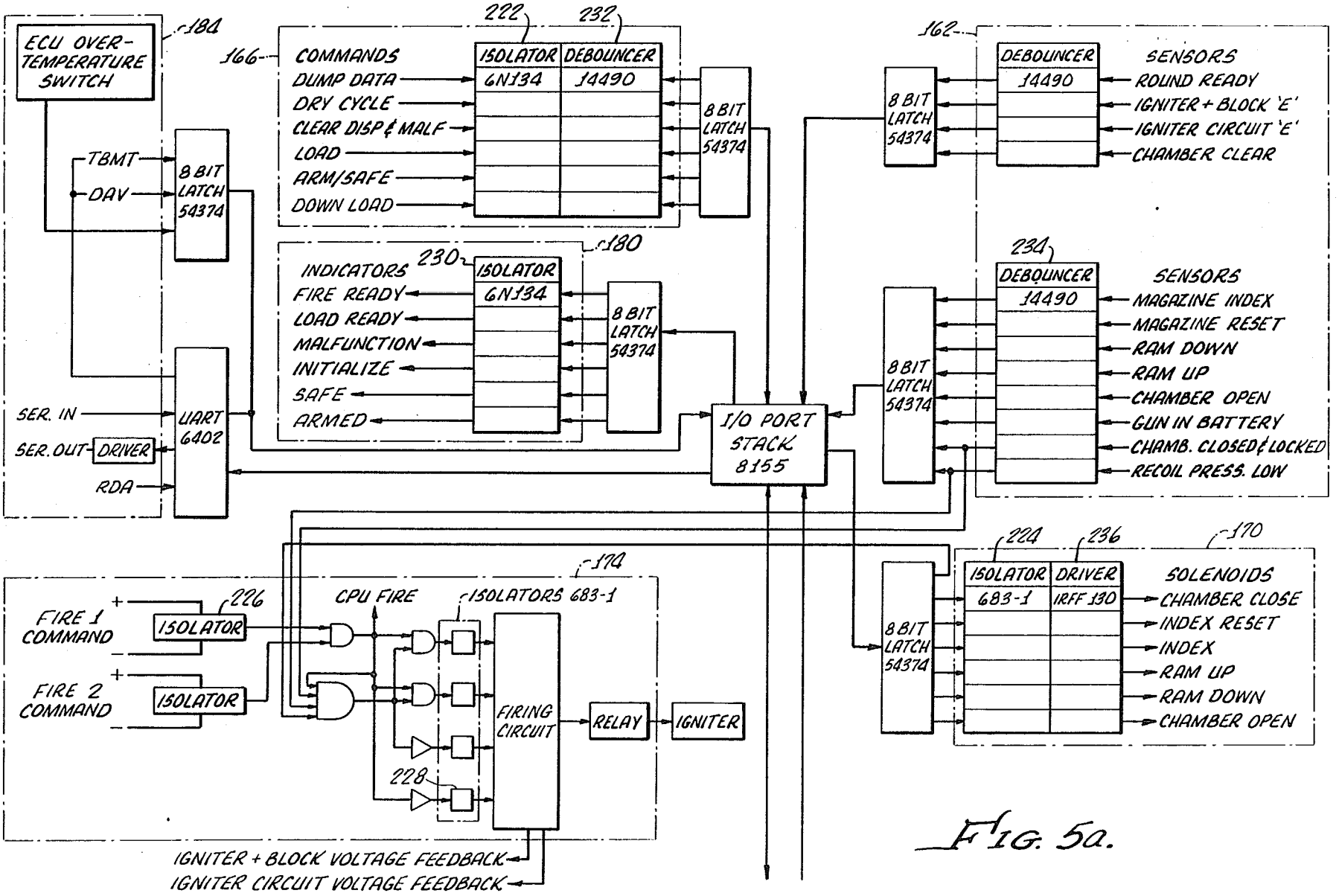
FIG. 5 is an electrical schematic drawing showing an exemplary manner in which the electronic control means of FIG. 1 can be implemented (FIG. 5 being divided into 5*a* and 5*b*)
Figure 5B:
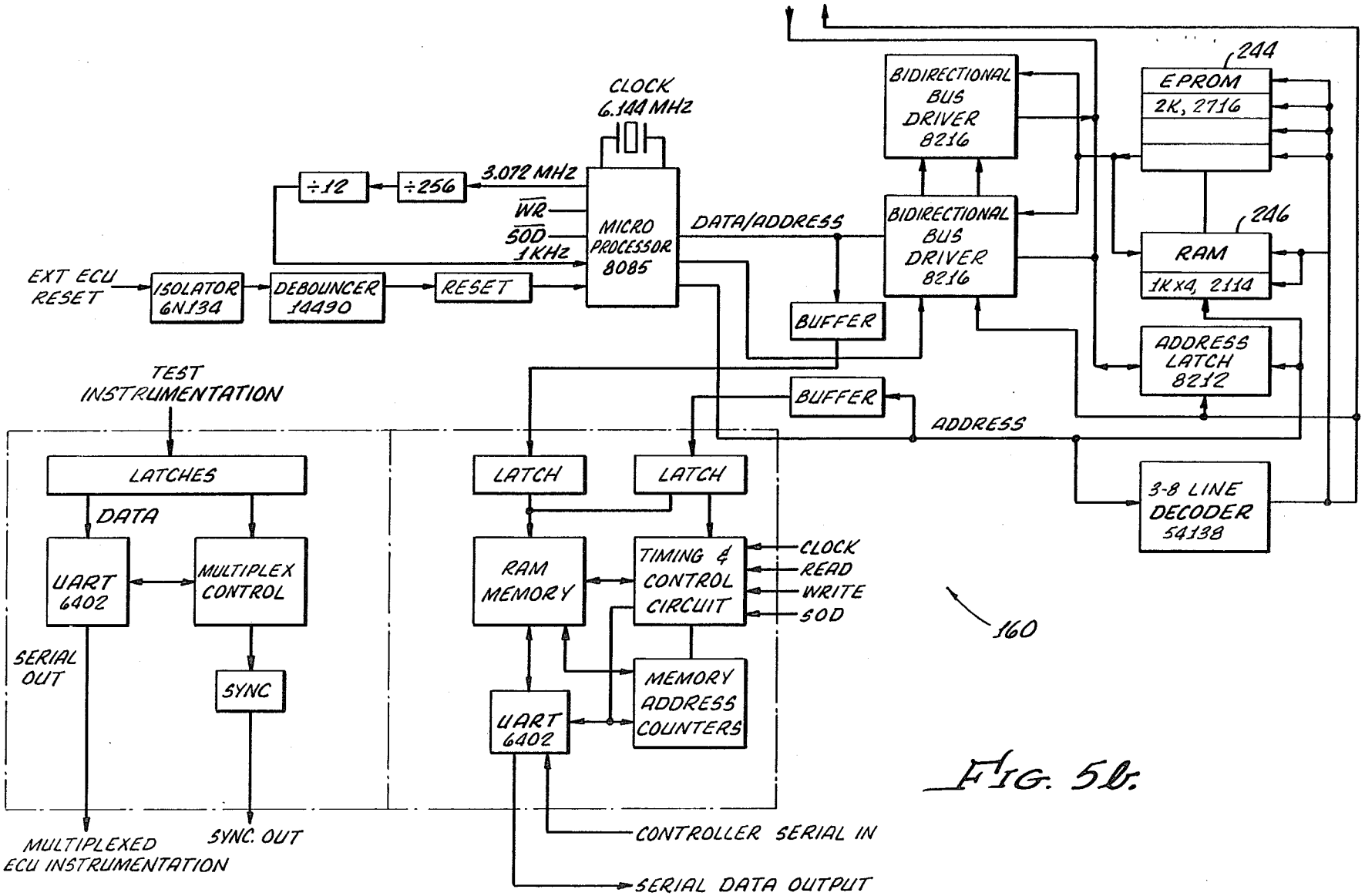

An exemplary embodiment of electronic control means 34 is shown in electric schematic form in FIG. 5. As shown in FIG. 5, the circuitry is, for purposes of easier understanding, generally partitioned into the various functional blocks identified by reference numbers 162, 166, 170, 174, 180 and 184 in FIG. 2. Controller 160 of FIG. 2, although shown as a discrete functional block is, in fact, distributed throughout the remaining blocks and so is not separately identified in FIG. 5.

The circuitry depicted in FIG. 5 will be self-explanatory to those skilled in the electronic arts and conventional symbols are used to designate such standard electronic functions as gates and amplifiers. Reference is additionally made as appropriate to specific part numbers of electronic elements or integrated circuits which may be used. Circuit functions not specifically identified by part number are identified by commonly known functional names. It is, therefore, considered that, other than to the extent provided below, a detailed description of FIG. 5 is unnecessary.

As is apparent from FIGS. 2 and 3, as well as from the above-related description, electronic control means 34 operate internally on logic voltage and power levels; whereas, command signals input into control means 34, as well as solenoid actuating signals and indicator signals output from the control means are a higher voltage and power levels. For example, the logic voltage levels may be about +5 Volts; whereas, command and control voltage levels may be at about +28 Volts. As a result of the two considerably different voltage levels involved, "decoupling" means are shown provided for isolating the two voltage levels from one another. Such isolation prevents possible damage to logic-performing portions of control means 34 by the higher voltage input signals and output commands. In addition, "debouncers", which are digital versions of analog fitters, are provided, in association with the decoupling means on input lines, to prevent signal noise surges into the control means. Also, a line driver is used in conjunction with the coupling means on serial data output line. Thus, as shown in FIG. 5, voltage decoupling is provided in command input channels 166, solenoid driver channels 170, firing circuit channel 174 and indicator output channels 180 by isolators 222, 224, 226 and 228 and 230, respectively. Debouncer 232 is associated with isolator 222 in command input channels 166. A debouncer 234 is also used in sensor input channels 162. Line driver 236 is used in association with isolator 224 in solenoid driver channels 170.

Figure 6:
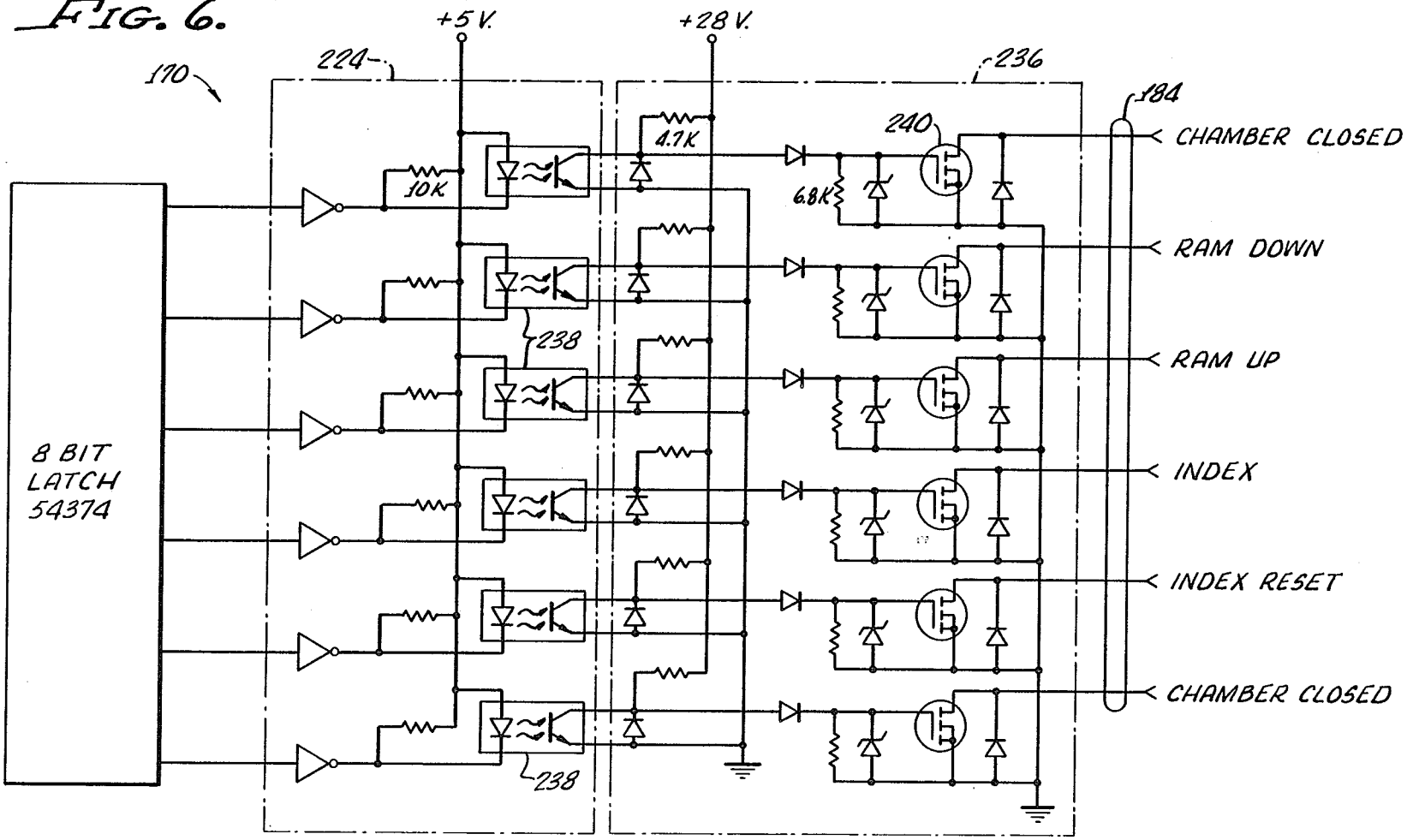
FIG. 6 is an electrical schematic drawing showing exemplary means for implementing decoupling between command and control voltages and logic voltages of the electronic control means; and, FIG. 7 is an electrical schematic drawing showing exemplary means for implementing debouncing portions of the electronic control means.

FIG. 6 illustrates a manner in which isolator 224 and driver 236 of solenoid driver channels 170 may be implemented. As shown, isolator 224 comprises a plurality of optical decoupling circuits 238 of the light emitting diode type, one such element being used for each solenoid valve control line in conduit 184. Similar optical decoupling circuits are used in the other isolators 222, 226 and 228 of FIG. 5. Associated driver 236 is also shown implmented in a conventional manner in FIG. 6, using FET transistors 240 for switching.

FIG. 7 shows a manner in which the debouncers of FIG. 5 may be implemented, debouncer 232, in conjunction with isolator 222, of command input channels 166 being shown by way of typical example. Isolator 222 comprises a plurality of optical decouplers 238 as was shown in FIG. 6 for isolator 224.

As further shown in FIG. 5, control means 34 includes a stack 244 of 2K EPROM's (erasable programmable read only memories) which may be programmed to store the sequence of operational steps and the positional and timing schedules described above. Included also is a stack 256 of 1K×4 RAM's (random access memories) which may be used to store such data as sensor outputs, number of shells fired and so forth.

It is to be understood that electronic control means 34, although described above as configured for use in a particular gun system 20, is not so limited. Control means 34, broadly described as responsive to sensing means 28 for controlling operation of actuating means 30, is adaptable to virtually any type of externally powered gun system which has a plurality of movable working parts which cause loading of shells from a shell supply into a gun for firing. Moreover, although control means 34 is particularly adapted for use with relatively large calibre cannon, for example, about 75 mm and larger, the present invention is not limited to such size guns. Nor is the present invention limited to guns firing cylindrical, telescoped ammunition, even though in large calibre cannon use of such type shells are advantageous for automation purposes.

Gun System 20 has been described herein as being externally powered with actuating means 30 being operated by a pressurized fluid, such as pressurized hydraulic fluid, from an independent source. As a result, gun system 20 is completely externally powered. It is to be appreciated that the pressurized fluid used to operate actuating means 30 may comprise a fluid pressurized, completely or partially, by high pressure barrel gases caused by firing gun 22. Under such circumstances, gun system 20 could be considered wholly or partly self-powered. However, for purposes of the present invention, such a gun would, nevertheless, be defined as an externally-powered gun.

Although there has been described above a specific arrangement of an externally powered, automatic gun system and electronic control means therefor, in accordance with the present invention, for purposes of illustrating the manner in which the invention may be used to advantage, it will be appreciated that the invention is not to be limited thereto. Accordingly, any and all modifications, variations or equivalent arrangements which may occur to those skilled in the art, should be considered to be within the scope of the invention as defined in the appended claims.

What is claimed is:

1. An externally powered automatic gun system which comprises:

(a) a gun having a shell chamber and a barrel and having chamber mounting means enabling the chamber to move between a closed position wherein a shell in the chamber is aligned with the barrel for firing and an open, shell loading position wherein the chamber is out of alignment with the barrel;

(b) shell supply means for storing shells to be loaded into and fired by the gun;

(c) shell feeding means for transferring shells from the supply means into the gun chamber;

said feeding means including shell advancing means enabling the serial advancing of shells from the shell supply means to a shell pickup position and shell ramming means enabling the serial feeding of shells from the pickup position into the open chamber;

(d) actuating means connected to said chamber mounting means, to said shell advancing means and to said shell ramming means for causing operational actuation thereof;

(e) firing means for causing the firing of shells in the closed chamber;

(f) sensing means for electrically sensing when the chamber is open or closed and for electrically sensing when preselected operating parts of the shell advancing means and the shell ramming means are in preselected operational positions and for providing electric output signals corresponding to the sensed positions;

(g) timing means responsive to the sensor output signals for determining the lengths of time actually required by the actuating means to move said chamber and said preselected operating parts between sensed positions related thereto;

(h) electronic control means connected for automatically controlling the actuating means and firing means, in accordance with a pre-established sequence of operational steps, so as to cause the chamber to open and close and to cause the advancing of shells from the shell supply means to the pickup position and from the shell pickup position into the chamber in a manner causing the loading and firing of the gun;

said control means being responsive to the sensing means output signals and to the timing means for enabling the automatic proceeding from selected operational steps of said sequence to the next-in-sequence steps according to the criteria:

(i) the chamber is, for the involved operational step, in the open or closed position required by a pre-established chamber positional schedule; and
(ii) preslected ones of the preselected operating parts of the shell advancing means and the shell ramming means are, for the operational step involved, positioned as required by a pre-established operational parts positional schedule; and
(iii) preselected ones of the operating time lengths, as determined by the timing means, are, for the operational step involved, within time limits allowed by a pre-established operating time schedule.

2. An externally powered, automatic gun system which comprises:
(a) a gun having a shell chamber and a gun barrel, and being mounted for recoiling, after firing, out of an at-rest, battery position;
(b) shell supply means for holding shells to be fired by the gun;
(c) a plurality of operating means enabling the opening and closing of the shell chamber and the transferring of shells from the shell supply means into the chamber for firing;
(d) actuating means connected to the plurality of operating means for causing actuation thereof;
(e) firing means for causing firing of shells in the shell chamber;
(f) sensing means for automatically sensing preselected operating positions of the plurality of operating means, and being operative for sensing whether or not the gun is in said battery position;
(g) timing means, responsive to the sensing means, for determining operating lengths of time of the plurality of the operating means by the actuating means, and being operative for determining, after a shell firing, the length of time required for the gun to return to the battery position; and
(h) electronic control means connected to the actuating means and firing means for the controlling thereof in accordance with a pre-established sequence of operating steps causing the automatic loading and firing of the gun,
said control means being responsive to the sensing means and timing means so as to cause the proceeding from selected operational steps to the next-in-sequence operational steps according to the criteria that:
(i) preselected ones of the plurality of operating means are positioned as required, for the operational step involved, by a pre-established positional schedule, and
(ii) preselected ones of the operating time lengths are, for the operational step involved, within operating limits allowed by a pre-established timing schedule.

3. The automatic gun system as claimed in claim 1 wherein the gun is mounted for recoiling, after firing, out of an at-rest, battery position, wherein the sensing means are operative for sensing whether or not the gun is in said battery position, and wherein the timing means are operative for determining, after a shell firing, the length of time required for the gun to return to the battery position.

4. The automatic gun system as claimed in claim 3 or 2 wherein the electronic control means are operative for causing the automatic proceeding from at least one step of the sequence of operational steps to the next-in-sequence step only if the gun is in battery, as required by the positional schedule for the operating step involved.

5. The automatic gun system as claimed in claim 3 or 2 wherein the control means include means enabling the automatic burst firing of a preselected number of shells, the loading and firing of each shell of the selected number being accomplished in accordance with said sequence of operational steps and being conditioned on the criteria for proceeding from one step of the sequence to the next step of the sequence, the automatic proceeding from one sequence of operational steps to the next sequence of operational steps being also conditioned on said criteria.

6. The automatic gun system as claimed in claim 5 wherein the control means are operative for proceeding from one sequence of operational steps causing the loading and firing of one shell to the next sequence of operational steps causing the loading and firing of a next shell only if the length of the out-of-battery time caused by the firing of said one shell is within an out-of-battery timing range allowed by the timing schedule.

7. The automatic gun system as claimed in claim 1 including malfunction indicating means for providing malfunction information as to the reason for failure of the control means to cause the proceeding from one step of the sequence of operating steps to the next-in-sequence step or to cause, in a repetitive firing mode of operation, the proceeding from one sequence of operational steps to the next sequence of operational steps.

8. The automatic gun system as claimed in claim 7 wherein the malfunction indicating means provide the malfunction information to a visual display so as to enable an operator of the gun to see the malfunction reason.

9. The automatic gun system as claimed in claim 1 wherein said electronic control means are operative for selectively causing the actuating means to operate in accordance with a pre-established, sequence of test steps, using inert test rounds.

10. The automatic gun system according to claim 9 including data recording means connected to the sensing means and the timing means for recording operational position and operational length of time data for selected steps in the sequence of test steps.

11. The automatic gun system as claimed in claim 1 including data recording means connected to the sensing means and timing means for recording positional data and length-of-operating time data for selected ones of the operational steps.

12. An externally powered, automatic gun system which comprises:
(a) a gun having a shell chamber and a gun barrel;
(b) shell supply means for holding shells to be fired by the gun;
(c) a plurality of operating means enabling the opening and closing of the shell chamber and the transferring of shells from the shell supply means into the chamber for firing;
(d) actuating means connected to the plurality of operating means for causing actuation thereof;
(e) firing means for causing firing of shells in the shell chamber;
(f) sensing means for automatically sensing preselected operating positions of the plurality of operating means;
(g) timing means, responsive to the sensing means, for determining operating lengths of time of the plurality of the operating means by the actuating means;

(h) electronic control means connected to the actuating means and firing means for the controlling thereof in accordance with a pre-established sequence of operating steps causing the automatic loading and firing of the gun, said control means being responsive to the sensing means and timing means so as to cause the proceeding from selected operational steps to the next-in-sequence operational steps according to the criteria that:

(i) preselected ones of the plurality of operating means are positioned as required, for the operational step involved, by a pre-established positional schedule, and (ii) preselected ones of the operating time lengths are, for the operational step involved, within operating limits allowed by a pre-established timing schedule; and (i) failure predicting means for predicting when the actual lengths of operating times, as determined by the timing means, may, for selected steps in the sequence of operating steps, be expected to be outside the corresponding, pre-established operating time lengths allowed by the timing schedule, thereby predicting when a gun malfunction, caused by failure of the control means to cause the proceeding from one operational step in the sequence of operational steps to the next-in-sequence operational step, may be expected to occur.

13. The automatic gun system as claimed in claim 1 including failure predicitng means for predicting when the actual lengths of operating times, as determined by the timing means, may, for selected steps in the sequence of operating steps, be expected to be outside the corresponding, pre-established operating time lengths allowed by the timing schedule, thereby predicting when a gun malfunction, caused by failure of the control means to cause the proceeding from one operational step in the sequence of operational steps to the next-in-sequence operational step, may be expected to occur.

14. The automatic gun system as claimed in claim 13 or 12 wherein the failure predicting means include means for determining, for selected ones of the lengths of operating times provided by the timing means, the rates of change of the lengths of operating times per a selected number of shells fired, for next projecting the lengths of operating times forwardly at said predetermined rates of change until the projected lengths of operating times are outside of the pre-established lengths of operation times allowed by the timing schedule and for then determining the projected number of shells to be fired before pre-established lengths of times.

15. The automatic gun system as claimed in claim 14 wherein the failure predicting means are operational for updating, in accordance with a pre-established updating schedule, the determination of the projected number of shells to be fired before an out-of-limit length of operating time is projected to occur.

16. The automatic gun system as claimed in claim 1 wherein the gun chamber and shell supply means are configured for holding cylindrically shaped, telescoped shells and wherein said gun chamber is pivotally mounted relative to the gun for rotational movement between a closed, shell firing position and an open, shell loading position, a fired shell casing being caused to be ejected from the chamber by the loading of an unfired shell into the chamber.

17. In an externally-powered, automatic gun system having a gun with a chamber which can be opened and closed, having a shell supply for holding shells to be fired by the gun, having feeding means for feeding shells from the shell supply into the chamber for firing, having actuating means for causing the chamber to open and close and for causing the feeding means to feed shells from the shell supply into the gun chamber and having firing means for firing shells loaded into the chamber, electronic control apparatus for automatically controlling operation of said actuating means and said firing means so as to cause automated loading and firing of the gun, said control apparatus comprising:

(a) sensing means for electrically sensing the position of preselected parts of the gun system which are operationally movable by the actuating means for loading and firing of the gun, one of said preselected parts of the gun being the gun chamber said sensing means providing electric output signals corresponding to the positions sensed, and being configured for sensing when the chamber is open and when it is closed;

(b) timing means responsive to said sensing means output signals for determining the lengths of time required by the actuating means to operate additionally selected ones of said preselected parts, said timing means being configured for determining the length of time required by the actuating means to close the chamber from the open chamber condition condition and to open the chamber from the closed chamber condition;

(c) storage means for storing, for a pre-established sequence of operational steps causing the automatic loading and firing of the gun by the actuating means, a first, pre-established schedule of required positions of said preselected parts and a second, pre-established schedule of allowable lengths of operating times for said additionally selected parts by the actuating means; and (d) electronic control means electrically connected to the actuating means and the firing means for causing loading and firing of the gun by a sequential step-by-step performance of the preselected sequence of operational steps. said control means causing the automatic proceeding from selected operational steps to the next-in-sequence steps on a go, no-go basis, a successive step being initiated only if, for the step involved, preselected ones of the preselected parts are positioned as required by said first schedule and preselected preceding ones of the lengths of operating times are within the lengths of times allowed by said second schedule.

18. In an externally-powered, automatic gun system having a gun which is mounted for recoilng after firing from a static, battery position and which has a chamber which can be opened and closed, having a shell supply for holding shells to be fired by the gun, having feeding means for feeding shells from the shell supply into the chamber for firing, having actuating means for causing the chamber to open and close and for causing the feeding means to feed shells from the shell supply into the gun chamber and having firing means for firing shells loaded into the chamber, electronic control apparatus for automatically controlling operation of said actuating means and said firing means so as to cause automated loading and firing of the gun, said control apparatus comprising:

(a) sensing means for electrically sensing the position of preselected parts of the gun system which are operationally movable by the actuating means for loading and firing of the gun, said sensing means providing electric output signals corresponding to the positions sensed and being configured for sensing when the gun is in the battery position;

(b) timing means responsive to said sensing means output signals for determining the lengths of time required by the actuating means to operate additionally selected ones of said preselected parts said timing means being configured for determining the length of out-of-battery time after firing;

(c) storage means for storing, for a pre-established sequence of operational steps causing the automatic loading and firing of the gun by the actuating means, a first, pre-established schedule of required positions of said preselected parts and a second, pre-established schedule of allowable lengths of operating times for said additionally selected parts by the actuating means; and (d) electronic control means electrically connected to the actuating means and the firing means for causing loading and firing of the gun by a sequential step-by-step performance of the preselected sequence of operational steps, said control means being configured for causing the sequence of operational steps to be automatically repeated for a selected number of times so as to enable automatic burst firing of the gun; the automatic proceeding from the last operational step in one sequence of operational steps to the first operational step in the next successive sequence of operational steps being also on said go, no-go basis;

said control means causing the automatic proceeding from selected operational steps to the next-in-sequence steps on a go, no-go basis, a successive step being initiated only if, for the step involved, preselected ones of the preselected parts are positioned as required by said first schedule and preselected preceding ones of the lengths of operating times are within the lengths of times allowed by said second schedule.

19. The electronic control apparatus as claimed in claim 18 wherein the go, no-go basis for proceeding from one sequence of operational steps through the next successive sequence of operating steps causing a next firing includes the requirement by the first schedule that the gun be in battery and that the determined out-of-battery time for the preceding firing be within a pre-established length of out-of-battery time allowed by the timing schedule.

20. In an externally-powered, automatic gun system having a gun with a chamber which can be opened and closed, having a shell supply for holding shells to be fired by the gun, having feeding means for feeding shells from the shell supply into the chamber for firing, having actuating means for causing the chamber to open and close and for causing the feeding means to feed shells from the shell supply into the gun chamber and having firing means for firing shells loaded into the chamber, electronic control apparatus for automatically controlling operation of said actuating means and said firing means so as to cause automated loading and firing of the gun, said control apparatus comprising:

(a) sensing means for electrically sensing the position of preselected parts of the gun system which are operationally movable by the acuating means for loading and firing of the gun, said sensing means providing electric output signals corresponding to the positions sensed;

(b) timing means responsive to said sensing means output signals for determining the lengths of time required by the actuating means to operate additionally selected ones of said preselected parts;

(c) storage means for storing, for a pre-established sequence of operational steps causing the automatic loading and firing of the gun by the actuating means, a first, pre-established schedule of required positions of said preselected parts and a second, pre-established schedule of allowable lengths of operating times for said additionally selected parts by the actuating means;

(d) electronic control means electrically connected to the actuating means and the firing means for causing loading and firing of the gun by a sequential step-by-step performance of the preselected sequence of operational steps, said control means causing the automatic proceeding from selected operational steps to the next-in-sequence steps on a go, no-go basis, a successive step being intitiated only if, for the step involved, preselected ones of the preselected parts are positioned as required by said first schedule and preselected preceding ones of the lengths of operating times are within the lengths of times allowed by said second schedule; and (e) malfunction predicting means for predicting the approximate number of firing before the occurrence of a no-go condition in which the control means stop the sequence of operating steps or stop the progressing from one sequence of operating steps to the next successive sequence of operating steps.

21. The electronic control apparatus as claimed in claim 20 wherein said malfunction predicting means include means for determining the rate of change of selected ones of the lengths of operating times with the number of shells fired, and for extrapolating the lengths of operating times forwardly, in terms of the number of shells to be fired and on the basis of the determined rate of change, until at least one of the projected lengths of operating time falls outside the corresponding length of operating time allowed by the timing schedule, a prediction as to the number of shells to be fired before a malfunction occurs being thereby enabled.

22. The invention as claimed in claim 1 wherein the control means include initializing means for causing, prior to initiating the first step of the sequence of operating steps, preselected ones of the preselected parts to move to pre-established initializing positions, the initiation of the first step of the sequence of operating steps being conditioned upon said preselected ones of the preselected parts being in said initializing positions.

23. An externally powered automatic gun system which comprises:

(a) a gun having a shell chamber, a barrel, and a pressurized fluid recoil buffer, and having chamber mounting means enabling the chamber to move between a closed position wherein a shell in the chamber is aligned with the barrel for firing and an open, shell loading position wherein the chamber is out of alignment with the barrel;

(b) shell supply means for storing shells to be loaded into and fired by the gun;

(c) shell feeding means for transferring shells from the shell supply means into the gun chamber;

said feeding means including shell advancing means enabling the serial advancing of shells from the shell supply means to a shell pickup position and shell ramming means enabling the serial feeding of shells from the pickup position into the open chamber;

(d) actuating means connected to said chamber mounting means, to said shell advancing means and to said shell ramming means for causing operational actuation thereof;

(e) firing means for causing the firing of shells in the closed chamber;

(f) sensing means for electrically sensing when the chamber is open or closed, for electrically sensing when preselected operating parts of the shell advancing means and the shell ramming means are in preselected operational positions, for providing electric output signals corresponding to the sensed positions and for sensing fluid pressure in the buffer;

(g) timing means responsive to the sensor output signals for determining the lengths of time actually required by the actuating means to move said chamber and said preselected operating parts between sensed positions related thereto;

(h) electronic control means connected for automatically controlling the actuating means and firing means, in accordance with a pre-established sequence of operational steps, so as to cause the chamber to open and close and to cause the advancing of shells from the shell supply means to the pickup position and from the shell pickup position into the chamber in a manner causing the loading and firing of the gun;

said control means being responsive to the sensing means output signals and to the timing means for enabling the automatic proceeding from selected operational steps of said sequence to the next-in-sequence steps according to the criteria:

(i) the chamber is, for the involved operational step, in the open or closed position required by a pre-established chamber positional schedule; and (ii) preselected ones of the preselected operating parts of the shell ramming means are, for the operational step involved, positioned as required by a pre-established operational parts positional schedule; and (iii) preselected ones of the operating time lengths, as determined by the timing means, are, for the operational step involved, within time limits allowed by a pre-established operating time schedule.

24. The automatic gun as claimed in claim 23 wherein the electronic control means are operative for causing the firing means to fire a shell chamber only if the sensed fluid pressure in the buffer is greater than a pre-established buffer pressure level.

25. An externally powered, automatic gun system which comprises:

(a) a gun having a shell chamber, a gun barrel and a pressurized fluid recoil buffer;

(b) shell supply means for holding shells to be fired by the gun;

(c) a plurality of operating means enabling the opening and closing of the shell chamber and the transferring of shells from the shell supply means into the chamber for firing;

(d) actuating means connected to the plurality of operating means for causing actuation thereof;

(e) firing means for causing firing of shells in the shell chamber;

(f) sensing means for automatically sensing preselected operating positions of the plurality of operating means and for sensing fluid pressure in the buffer;

(g) timing means, responsive to the sensing means, for determining operating lengths of time of the plurality of the operating means by the actuating means; and (h) electronic control means connected to the actuating means and firing means for the controlling thereof in accordance with a pre-established sequence of operating steps causing the automatic loading and firing of the gun, said control means being responsive to the sensing means and timing means so as to cause the proceeding from selected operational steps to the next-in-sequence operational steps according to the criteria that:

(i) preselected ones of the plurality of operating means are positioned as required, for the operational step involved, by a pre-established positional schedule, and (ii) preselected ones of the operating time lengths are, for the operational steps involved, within operating limits allowed by a pre-established timing schedule, said control means being operative for causing the firing means to fire a shell in the chamber only if the sensed fluid pressure in the buffer is greater than a pre-established buffer pressure level.

* * * * *